US011891996B2

(12) United States Patent
Lato et al.

(10) Patent No.: US 11,891,996 B2
(45) Date of Patent: Feb. 6, 2024

(54) COMPRESSOR ELEMENT WITH IMPROVED OIL INJECTOR

(71) Applicant: ATLAS COPCO AIRPOWER, NAAMLOZE VENNOOTSCHAP, Wilrijk (BE)

(72) Inventors: Fernanda Lato, Wilrijk (BE); Michaël Raphaël Angèle Adens, Wilrijk (BE); Andrew Aristizabal, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 17/923,093

(22) PCT Filed: May 6, 2021

(86) PCT No.: PCT/IB2021/053835

§ 371 (c)(1),
(2) Date: Nov. 3, 2022

(87) PCT Pub. No.: WO2021/224842

PCT Pub. Date: Nov. 11, 2021

(65) Prior Publication Data

US 2023/0175508 A1 Jun. 8, 2023

(30) Foreign Application Priority Data

May 7, 2020 (BE) ..... 2020/5308

(51) Int. Cl.
*F04C 29/02* (2006.01)
*F04C 29/04* (2006.01)

(52) U.S. Cl.
CPC ..... *F04C 29/02* (2013.01); *F04C 29/042* (2013.01)

(58) Field of Classification Search
CPC ..... F04C 18/16; F04C 29/02; F04C 29/042
See application file for complete search history.

(56) References Cited

U.S. PATENT DOCUMENTS

2003/0070878 A1 4/2003 Zhong et al.
2009/0136372 A1* 5/2009 Elson ..... F04C 29/02 418/55.6

(Continued)

FOREIGN PATENT DOCUMENTS

CN 103470506 A 12/2013
CN 108730191 A 11/2018

(Continued)

OTHER PUBLICATIONS

Written Opinion for PCT/IB2021/053835 dated May 27, 2021.

(Continued)

*Primary Examiner* — Anthony Ayala Delgado
(74) *Attorney, Agent, or Firm* — Sughrue Mion, PLLC

(57) ABSTRACT

A compressor element (1) comprising at least one compression member (2), a housing (3) and a rotatable shaft (4) rotatably connecting the at least one compression member (2) to the housing (3), wherein at least one intermediate element (5) is provided between the rotatable shaft (4) and the housing (3) for facilitating rotation of the rotatable shaft (4), wherein the compressor element (1) further comprises at least one oil injector (6) extending from an inlet port (7) to at least one nozzle (8*a*, 8*b*, 8*c*) via an oil channel (9), wherein the oil channel (9) is shaped to allow a substantially primary flow of oil through the channel (9) for cooling of the at least one intermediate element (5).

11 Claims, 7 Drawing Sheets

(56) References Cited

U.S. PATENT DOCUMENTS

| | | | | |
|---|---|---|---|---|
| 2015/0023826 | A1* | 1/2015 | Desiron | F04C 2/16 417/410.1 |
| 2020/0102959 | A1* | 4/2020 | Desiron | F04C 29/026 |

FOREIGN PATENT DOCUMENTS

| | | | |
|---|---|---|---|
| DE | 10 2016 011 442 | A1 | 3/2018 |
| JP | 07-103152 | A | 4/1995 |
| WO | 83/03641 | A1 | 10/1983 |
| WO | 2013/126970 | A1 | 9/2013 |

OTHER PUBLICATIONS

International Search Report for PCT/IB2021/053835 dated May 27, 2021.
International Preliminary Report on Patentability for PCT/IB2021/053835 dated Apr. 4, 2022.
Office Action dated Mar. 6, 2023 in Chinese Application No. 202110493069.2.

* cited by examiner

COMPRESSOR ELEMENT WITH IMPROVED OIL INJECTOR

This Application is a National Stage of International Application No. PCT/IB2021/053835 filed May 6, 2021, claiming priority based on Belgian Patent Application No. 2020/5308 filed May 7, 2020.

The field of the invention relates to a compressor element comprising at least one compression member, a housing and a rotatable shaft rotatably connecting the at least one compression member to the housing, wherein at least one intermediate element is provided between the rotatable shaft and the housing for facilitating rotation of the rotatable shaft in the housing.

Compressor systems are mechanically or electromechanically driven systems configured to increase pressure of a gaseous fluid by reducing its volume. In other words, the compressor system performs a compression process. The compression process may be approximated as an adiabatic process when substantially no transfer of heat or mass of the gaseous fluid occurs between the compressor system and an environment thereof. When the compressor system adiabatically compresses gaseous fluids, it generates waste heat. Moreover, the compressor system, in particular a driving means thereof, generates heat via friction. For optimal performance of the driving means and by extension the compressor system, cooling is required.

U.S. Pat. No. 4,780,061 discloses a screw compressor system having a motor housing section with a compressor drive motor, a compressor section with a compressor element and an oil separator downstream of a discharge port of the compressor element. The compressor drive motor is cooled by suction gas traveling to a working chamber of the compressor element. As a cooling system, a cooling oil is either directly injected into the working chamber of the compressor element or is delivered via internal flow paths to bearing surfaces. An integral heat exchange structure, which is used to cool the oil, is in turn also cooled by the suction gas traveling to the working chamber.

In this known cooling system the bearing surfaces are not efficiently cooled and therefore the performance of the compressor system is suboptimal.

The object of the present invention is to provide a solution to any of the aforementioned and/or other disadvantages.

A more specific object of embodiments of the present invention is to improve the performance of the compressor system.

According to an aspect of the invention there is provided a compressor element comprising at least one compression member, a housing and a rotatable shaft rotatably connecting the at least one compression member to the housing, wherein at least one intermediate element is provided between the rotatable shaft and the housing for facilitating rotation of the rotatable shaft, wherein the compressor element further comprises at least one oil injector extending from an inlet port to at least one nozzle via an oil channel, wherein the oil channel is shaped to allow a substantially primary flow of oil through the oil channel for cooling of the at least one intermediate element.

By providing an oil injector the at least one intermediate element may be optimally cooled since a specific rate of oil may be applied for each heat generating intermediate element. Moreover, an installation of such an oil injector is simple. Additionally, by shaping the oil channel such that a substantially primary flow of oil is formed, formation of vortices in the flow of oil is reduced and a resulting oil jet ejected from the at least one nozzle is uniform and continuous. Consequently, oil can be targeted at the intermediate element more efficiently, thereby improving efficiency of the compressor element. Thus, the cooling performance of the oil injector is improved, ergo the performance of the compressor element is improved. Oil is needed to both lubricate and cool a bearing as intermediate element during operation. Due to the complexity of making cooling channels on an outside/inside bearing race an injection of oil is needed. This allows for direct cooling as well as lubrication of the bearing. It is advantageous to reduce an amount of oil for cooling because, since the oil gets moved by the rollers as they pass by, causing friction and losses in the oil. The invention allows to have the same cooling effect with less mass flow of oil into the bearings compared to already known oil injectors.

Preferably, a substantially primary flow is a flow substantially free from secondary flows. In the context of the application a primary flow is defined as a flow parallel to a main direction of a fluid motion of the flow of oil. The main direction is a direction determined by a centre line of the oil channel. In the context of the application a secondary flow is defined as a flow having a transverse direction of movement superposed on a primary direction of movement. The secondary flow is perpendicular to the main direction of the fluid motion of the flow of oil. The secondary flow develops due to centrifugal instabilities and forms vortices seen in a plane perpendicular to the main direction. Because the primary flow is substantially free from secondary flows, the primary flow is substantially unidirectional. In other words, the flow of oil is aligned with the direction of the oil channel. Flows free from secondary flows may also be considered as laminar flows. In this way, the resulting oil jet is more uniform and continuous.

Preferably, the primary flow comprises a Dean number which is smaller than 75, preferably smaller than 65, preferably smaller than 60. By having a smaller Dean number the development of centrifugal instabilities resulting in secondary flows is reduced or does not even transpire. This further improves uniformity and continuity of the oil jet.

Preferably, the Dean number is determined by the formula:

$$De = Re \cdot \sqrt{\frac{D_n}{2 \cdot r}}$$

wherein Re represent a Reynolds number of the flow of oil; wherein $D_n$ represents an inner diameter of the oil channel; and wherein r represents a radius of curvature of the oil channel or a portion thereof.

The advantage hereof is that in this way substantially the same or a higher mass flow rate of the primary flow may be achieved for, for example, substantially the same pumping power to get the oil through the oil channel. Thus, the performance of the compressor element is improved. Moreover, the stability of the Dean number may be maintained for higher and/or lower mass flow rates and/or more acute radii of curvature. In this way the oil nozzle has a substantially high level of flexible usability. Additionally, the resulting oil jet is compact.

Preferably, the at least one intermediate element comprises at least one of a roller bearing and a gear. More preferably, the at least one intermediate element comprises at least one roller bearing. Roller bearings typically generate heat due to friction between bearing balls and a bearing raceway. The friction is inherently present. In roller bearings this may be worsened by cyclic stress developed during operation of the compressor element. The roller bearings may be cooled using an internally integrated pathway for oil. The disadvantage hereof is that the roller bearing is insufficiently cooled, in particular in the case of high load and high speed applications, such as compressor systems. Integrated pathways furthermore introduce unwanted leak paths throughout the compressor system through which oil may leak. Alternatively, fluid bearings may be used. However, fluid bearings are prone to quick failure due to contaminants such as grit or dust. Moreover, fluid bearings are expensive, complex to manufacture and require more energy to operate than roller bearings. By using the roller bearings and cooling said roller bearings using the oil injector according to the invention, the compressor system may be more easily fabricated.

Preferably, an oil channel comprises at least two nozzles. In this way multiple to be cooled areas of the at least one intermediate element or multiple intermediate elements may be cooled simultaneously using two nozzles. Preferably, the oil channel is branched. By branching the oil channel multiple areas of the at least one intermediate element or multiple intermediate elements may be cooled using a branched oil channel. A single oil injector is, in the context of the application defined, as an oil injector having one inlet port. The single oil injector may comprise one or more oil channels and each oil channel may comprise one or more nozzles. In this way, a single oil injector may be used to cool multiple intermediate elements arranged in proximity of each other or may cool multiple areas of an intermediate element. It will be clear to the skilled person that multiple areas of multiple intermediate elements may be cooled using a single oil branch. An additional advantage is that each branch is customizable to extend to a different intermediate element.

Preferably, a radius of curvature of the oil channel, is larger than at least 5 mm, preferably larger than at least 10 mm, preferably larger than 20 mm. In the context of the invention, a radius of curvature is defined as the radius of a circle which touches a curve of the oil channel at a point on the centre line of the oil channel and has the same tangent and curvature as the oil channel at said point. In other words, it is a measure of how much the oil channel bends in a direction at that point. Oil injectors may be cast from metal. The oil injectors are further processed via micromachining techniques such as CNC techniques. CNC machined oil channels inherently form acute, obtuse or straight angles when intersecting with one and another. This results in a generation of vortices within the oil injector and finally in an unwanted dispersion of oil droplets. This dispersion of oil reduces the efficiency of oil hitting the intermediate element and thereby reduces the cooling performance of the oil injector. Additionally, the oil injectors are arranged in areas of the compressor system with very limited space. The oil injectors are therefore compact and substantially limited in size and shape.

In a preferred embodiment the at least one oil injector is arranged on the housing at a distance from the at least one intermediate element and the at least one oil nozzle is biased towards the at least one intermediate element and is configured to eject oil from the at least one oil nozzle, wherein the ejected oil is adapted to impact an injection location, wherein an area of the injection location is smaller than 10 $mm^2$, preferably smaller than 5 $mm^2$. By arranging the oil injector at a distance from the at least one intermediate element and ejecting a substantially primary oil stream on an injection location, areas which would otherwise be difficult to reach using conventional means may be cooled in a simple manner. By ejecting on an injection location with a limited area the heat transfer between the oil and the at least one intermediate element is improved. Thus the cooling of the compressor element is improved. Moreover, by impacting the injection location in particular, the areas wherein heat is generated can be cooled using a minimal amount of fluid. In other words, the intermediate elements are cooled with relatively high accuracy. The cooling of areas which do not generate heat is thus avoided which reduces the total amount of oil required for cooling the compressor element.

Preferably, an oil seal is arranged between the compression member and the at least one intermediate element on the rotatable shaft. In this way, the cooling oil does not invade the compression member. Cooling the compressor element with oil therefore does not pollute the compressed fluid. Consequently, equipment, such as valves or pistons, which may be situated downstream of the compressor element do not receive a contaminated compressed fluid. Moreover, food products and non-food products exposed to the compressed air are not contaminated by the oil. Thus, safety, hygiene and longevity of equipment as well as consumer products situated downstream of and coupled to the compressor element is improved.

Preferably, the compressor element further comprises at least one compression chamber and at least one driving section separated by a separation wall; wherein the at least one compression chamber comprises the at least one compression member and the at least one driving section comprises the at least one intermediate element arranged in the separation wall and wherein the rotatable shaft extends through the separation wall. In this way, oil ejected from the oil channel to the intermediate element is prevented from entering the compression chamber. Preferably, the oil seal may be arranged in the separation wall improving the prevention of oil entering the compression chamber.

The invention further relates to a method for manufacturing a compressor element comprising at least one compression member, a housing and a rotatable shaft rotatably connecting the at least one compression member to the housing, the method comprises providing at least one intermediate element between the rotatable shaft and the housing for facilitating rotation of the rotatable shaft, the method further comprises providing the compressor element with at least one oil injector extending from an inlet port to at least one nozzle via an oil channel, wherein the method further comprises shaping the oil channel is to allow a substantially primary flow of oil through the channel for cooling of the at least one intermediate element. Preferably, the oil channel is shaped to allow a flow which is substantially free from secondary flows and preferably with a Dean number smaller than 75, more preferably smaller than 65, most preferably smaller than 60.

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

Figure 1:
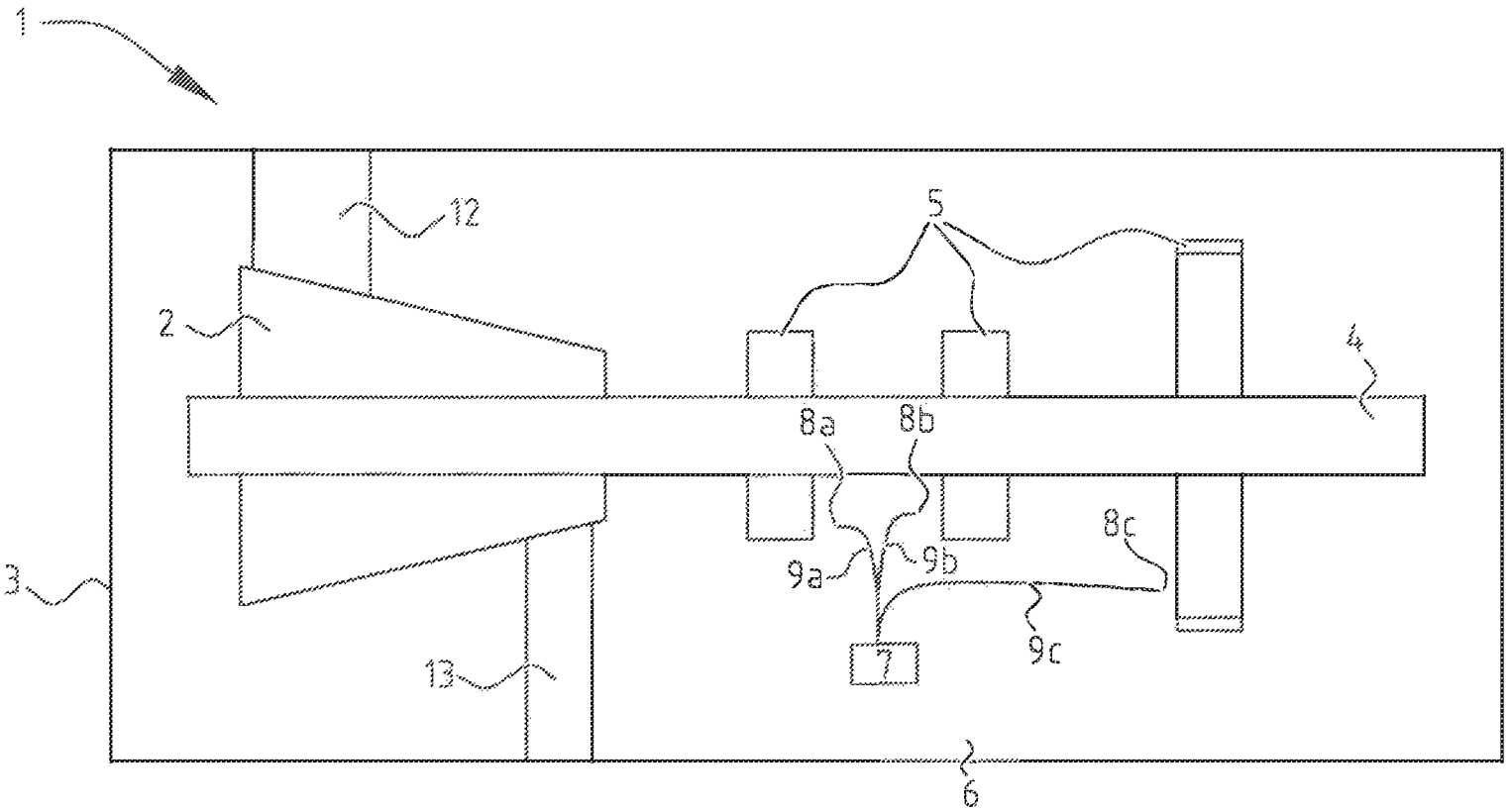
FIG. 1 is a schematic representation of an exemplary embodiment of a compressor element comprising an oil injector.

FIG. 1 illustrates an exemplary embodiment of a compressor element 1. The compressor element 1 is configured for compressing fluids. In the context of the application, fluids may be considered to include gases or combinations of gas and liquid. For example, the compressor element 1 may be configured to compress air from a low pressure to a high pressure with reference to the low pressure. For this reason the compressor element 1 is provided with a compression member 2.

The compressor element 1 further comprises a housing 3 and a rotatable shaft 4 rotatably connecting the at least one compression member 2 to the housing 3. The housing 3 may at least partially form the housing of the compression chamber 14 of the compression member 2 and/or may form a structural framework supporting auxiliary compressor means, for example a controllable inlet valve (not shown) or a heat exchanger (not shown).

The compression member 2 may be any one of the following or a combination thereof: rotary compression member, reciprocating compression member, centrifugal compression member or an axial compression member. For example, the compression member 2 may be a rotary-screw compressor element with two meshing helical screws, or alternatively, the compression member 2 may be a reciprocating compressor element. Moreover, a plurality of compression members 2 may be used such that a multi-stage compressor element is formed. The compression member 2 comprises a compressor inlet 12 configured to receive or draw in a fluid at an inlet pressure into a compression chamber 14. A compression housing delimits the compression chamber 14 (shown in FIG. 2) wherein a compression member 2 is arranged. The compression member 2 may, for example, be two meshing helical screws 2*a*, 2*b*. Alternatively, for example in the case of a centrifugal compression member, the compression member 2 may be a centrifugal impeller. The compression member 2 further comprises a compressor outlet 13 from which the fluid is ejected at a higher outlet pressure with respect to the inlet pressure. The compression member 2 may be an oil-free compression member. In the context of the application an oil-free compression member is defined as a compression member 2 wherein an intermediate element 5, such as a crank case or gearbox is isolated from the compression chamber 14. The intermediate element 5 is described further below. To achieve an oil-free compression element an oil seal 11 may be provided between the rotatable shaft 4 and a housing 3, see for example FIG. 2. The oil seal 11 is configured to prevent oil from leaking into the compression chamber 14. Moreover, the compression member 2 may be an oil-less compression member, this is defined as a compression member 2 using no oil. It will be clear to the skilled person that other alternative cooling fluids may be used in substantially the same way as oil. For example, water may be used. The preferred embodiment of the compressor element 1 is an air compressor element.

Figure 2:
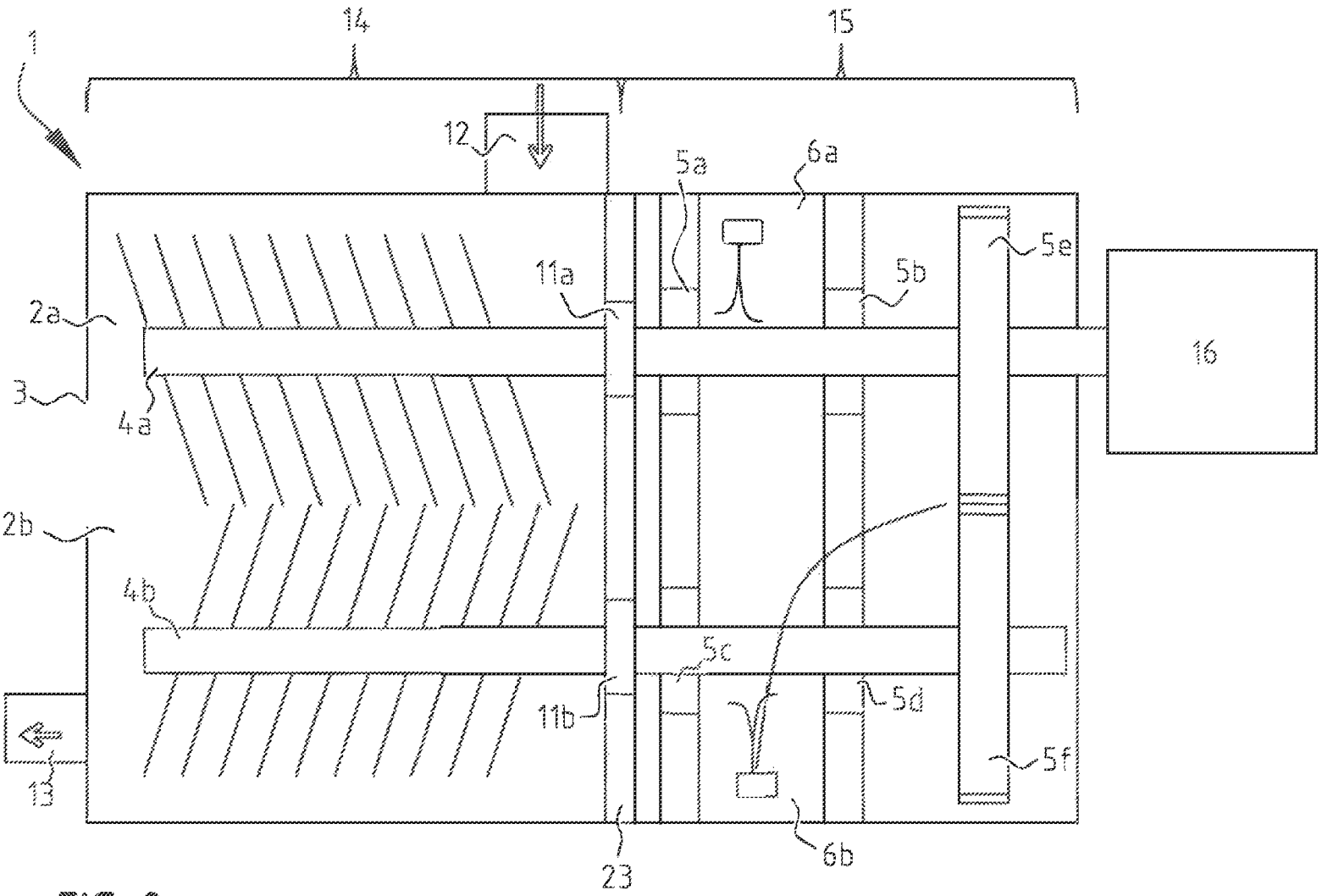
FIG. 2 is a schematic representation of an exemplary embodiment of a compressor element comprising an oil injector and an oil seal.

The rotatable shaft 4 is arranged in the compressor element 1 such that a rotating motion thereof at least drives the compression member 2. In other words, the rotatable shaft 4 rotatably connects the at least one compression member 2 to the housing 3 and rotates around its longitudinal axis. For this reason the rotatable shaft 4 may be rotatably supported by at least one intermediate element 5. The rotatable shaft 4 may be driven using the at least one intermediate element 5 or, alternatively, a driving means 16 (shown in FIG. 2) to rotate, typically at a predetermined speed. In the illustrated embodiment the compression member 2 is directly arranged on the rotatable shaft 4. Alternatively, the rotatable shaft 4 may be arranged at a distance of the compression member 2, for example in the case of a reciprocating compression member. A plurality of rotatable shafts 4*a*, 4*b*, as shown in FIGS. 2, 4, 6 and 7, may also be provided. As shown in FIG. 2, the rotatable shafts 4*a*, 4*b* may extend from a driving section 15 to the compression chamber 14. A primary function of the driving section 15 is driving the compression members 2*a*, 2*b*. Further details relating to the driving section 15 are explained here below.

The compressor element 1 further comprises at least one intermediate element 5. The intermediate element 5 is provided between the rotatable shaft 4 and the housing 3 for facilitating rotation of the rotatable shaft 4. The intermediate element 5 may be configured to rotatably support the rotatable shaft 4 with respect to the housing 3. The intermediate element 5 may be any one of a bearing or a gear. In the illustrated embodiment a radial bearing, an axial bearing and a gear are shown. The axial bearing is arranged preferably in the case of an oil-free compressor element such that a substantially axial load is supported by the axial bearing.

The compressor element 1 further comprises at least one oil injector 6. The oil injector 6 is configured for cooling of the at least one intermediate element 5 and/or the rotatable shaft 4. The oil injector 6 comprises an inlet port 7 and an oil channel 9 extending from the inlet port 7 to at least one nozzle 8. The oil injector 6 is arranged on the housing 3, preferably at a distance from the intermediate element 5 and the at least one nozzle 8 is biased to the intermediate element 5 or at least part of the intermediate element 5, for example a contact area of two gears or the area between raceways of a bearing. The oil nozzle 8 is configured to direct a flow of oil to the intermediate element 5. In a preferred embodiment the oil injector 6 is manufactured using additive manufacturing techniques. The oil injector 6 is preferably manufactured using metal. In other words, the oil injector 6 is integrally formed such that the oil injector 6 is free from leakage paths.

The inlet port 7 is arranged on the housing 3 or at least a portion thereof, and is in fluid connection with an oil cooling system (not shown). The inlet port 7 is configured to receive oil from the oil cooling system via supply channels. The oil cooling system may comprise a fluid circulation means, heat exchanging means and filtering means. The fluid circulation means is configured for supplying oil to the inlet port 7 via the supply channels (not shown). The heat exchanging means is configured to cool the supplied oil to the desired temperature for optimal cooling performance and the filtering means is configured to filter undesirable sediment and particles which may damage the intermediate elements 5 and/or rotatable shaft 4. The inlet port 7 may be attachable to the housing 3 via a bolt connection or clamping means or may be integrally formed with the housing 3 or at least a portion of the housing 3.

The oil channel 9 is shaped to allow a substantially primary flow of oil through it. The oil channel 9 comprises a proximal end situated on the inlet port 7 and extends to a nozzle 8 situated at a distal end of the oil channel 9. The oil channel 9 may extend in any direction of a three-dimensional space. The oil channel 9 comprises an oil channel wall delimiting a hollow central portion of the oil channel 9. The oil channel 9 may be straight or curved. Furthermore, the oil channel 9 may also comprise a transport section 18 and a nozzle section 19, shown in FIG. 5. The transport section 18 and the nozzle section 19 may be partially straight and/or partially curved or a combination thereof, this is further explained here below.

In a preferred embodiment the oil channel 9 is branched such that a plurality of oil channels 9*a*, 9*b*, 9*c* are formed. Each of the plurality of oil channels 9*a*, 9*b*, 9*c* may comprise at least one nozzle 8*a*, 8*b*, 8*c*. By having a plurality of oil channels 9*a*, 9*b*, 9*c* a single oil injector 6 may be used to cool a plurality of intermediate elements 5 or a plurality of parts of an intermediate element 5 or a combination thereof. In the illustrated embodiment of FIG. 1 the oil injector 6 is used to cool and lubricate a radial bearing, an axial bearing and a gear.

FIG. 2 illustrates an exemplary embodiment of a compressor element 1. Similar or identical parts have been indicated with the same reference numerals as in FIG. 1, and the description given above for FIG. 1 also applies for the components of FIG. 2.

The compressor element 1 illustrated in FIG. 2 comprises at least one compressor section 14 and at least one driving section 15. The at least one compression chamber 14 and the at least one driving section 15 are separated from each other by a separation wall 23. The separation wall 23 may be formed by the housing 3 or at least a portion thereof. The compression chamber 14 comprises the compressor inlet 12 and compressor outlet 13 and the compression member 2. The compression member 2 may comprise multiple compression members 2*a*, 2*b*, for example in the illustrated case of a rotary screw compressor element. Each of the compression members 2*a*, 2*b* is connected via a respective rotatable shaft 4*a*, 4*b* to the housing 3.

The plurality of rotatable shafts 4*a*, 4*b* rotatably connecting two compression members 2*a*, 2*b* to the housing 3 are shown to extend from the driving section 15 to the compression chamber 14. The driving section 15 comprises a plurality of intermediate elements 5*a*-5*f*. The rotatable shaft 4*a* is coupled to a driving means 16 arranged outside of the compressor element 1. The rotatable shaft 4*a* therefore extends through the housing 3. The driving means 16 is configured to drive the rotatable shaft 4*a* and by extension the compression members 2*a*, 2*b*. For this reason, the compressor element 1 may be provided with an intermediate element 5*e* arranged on the rotatable shaft 4*a* for transferring the rotational motion of said rotatable shaft 4*a*, via intermediate 5*e* to the rotatable shaft 4*b* using intermediate element 5*f*, for example a gearbox. A further driving section (not shown), typically embodying timing gears or synchronization gears, may be situated on the other side of the compression chamber 14 opposite to the driving section 15. The rotatable shafts 4*a*, 4*b* may extend in the further driving section such that an end of the rotatable shafts 4*a*, 4*b* may be provided with intermediate elements 5 between the rotatable shafts 4*a*, 4*b* and the housing 3, for example the intermediate elements 5 between the rotatable shafts 4*a*, 4*b* may be embodiment as a set of timing gears. In other words, the rotatable shafts 4*a*, 4*b* are rotatably connected to the housing 3 at least at both ends thereof. In an exemplary embodiment the further driving section may correspond to a bearing case.

Each of the intermediate elements 5*a*-5*d* is provided directly or indirectly between the rotatable shafts 4*a*, 4*b* and the housing 3, respectively, for facilitating the rotation of the rotatable shafts 4*a*, 4*b*. In the exemplary embodiment of FIG. 2, a plurality of oil injectors 6*a*, 6*b* is arranged in the compressor element 1. Each of the oil injectors 6*a*, 6*b* is configured for cooling of at least one intermediate element 5*a*-5*d*. The oil injectors 6*a*, 6*b* may be arranged at a same side of the driving section 15 or, as shown in FIG. 2, arranged on opposite sides.

Optionally, an oil seal 11*a*, 11*b* may be arranged between the compression member 2*a*, 2*b* and the intermediate element 5*a*, 5*c* on the rotatable shaft 4*a*, 4*b*. As illustrated in FIG. 2 the driving section 15, comprising a plurality of intermediate elements 5*a*-*f*, is separated from the compression chamber 14. Oil seals 11*a*, 11*b* may be arranged on each of the respective rotatable shafts 4*a*, 4*b* such that oil ejected from the plurality of oil injectors 6*a*, 6*b* is not allowed to enter the compression chamber 14. In the case that a further driving section (not shown) is arranged on the other side of the compression chamber 14 opposite to the driving section 15, further oil seals may be provided such that oil injected using yet another further oil injector arranged in the further driving section is not allowed to enter the compression chamber 14.

Figure 3B:
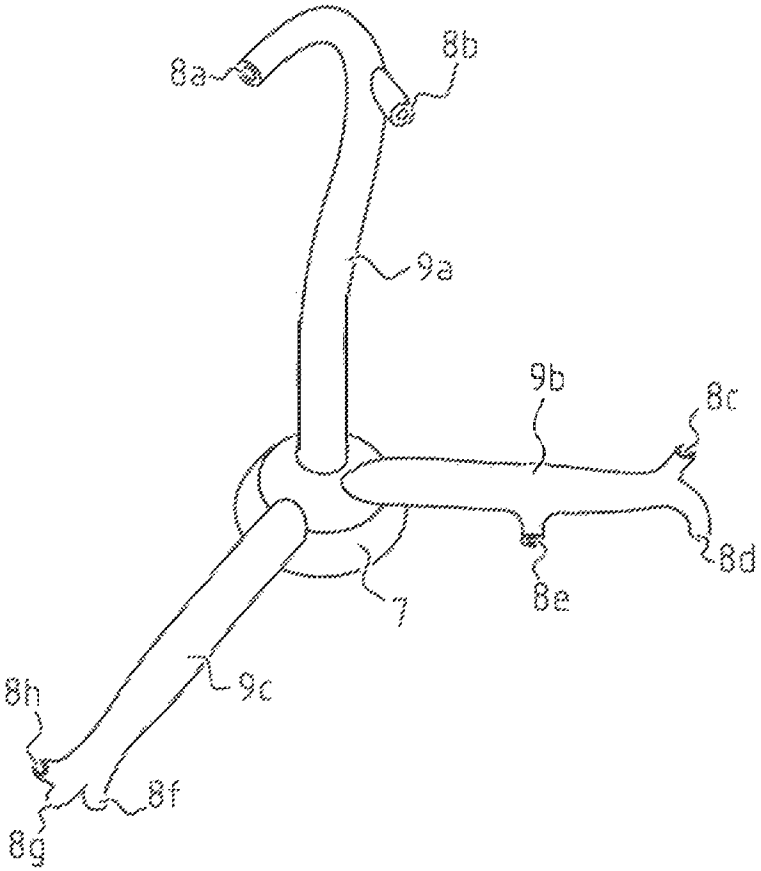
FIG. 3B is a schematic perspective view of an exemplary embodiment of an oil injector.
Figure 3A:
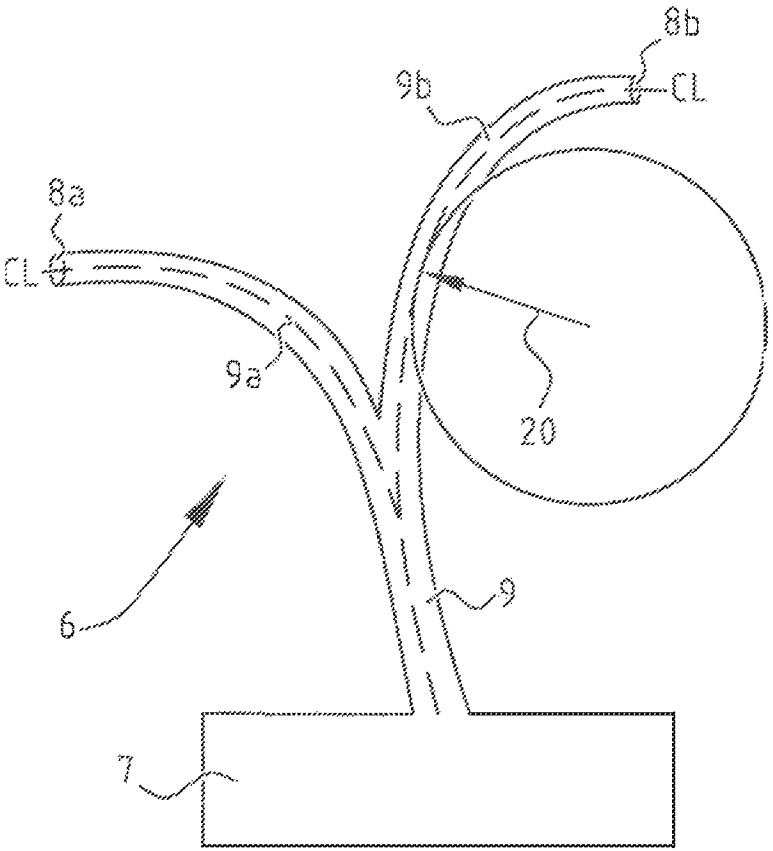
FIG. 3A is a schematic cross-sectional view of an exemplary embodiment of an oil injector.

FIG. 3A illustrates a schematic cross-sectional view of a different exemplary embodiment of an oil injector 6. In the embodiment of FIG. 3A, the oil channel 9 is shown to be branched into a first oil channel 9*a* and a second oil channel 9*b*. Each of the first and second oil channel 9*a*, 9*b* comprises at least one nozzle 8*a*, 8*b*, respectively. Optionally, the first and second oil channel 9*a*, 9*b* may share a common oil channel 9 extending from the inlet port 7.

FIG. 3A illustrates furthermore that an inner diameter of the oil channel 9 is substantially constant for each section thereof. To allow a substantially primary flow of oil the oil channel 9, in particular a bend thereof, comprises a radius of curvature 20, shown in FIG. 3A, at the center line CL of the oil channel 9 which is larger than 5 mm, preferably, larger than 10 mm, more preferably larger than 20 mm. It will be clear that such a radius of curvature 20 applies to the entire length of an oil channel 9. In this way, no acute, obtuse or straight angles are formed by the oil channel 9. The skilled person will appreciate that the oil channel 9 may comprise a plurality of radii of curvature 20, for example when the oil channel 9 comprises a plurality of bends. In this exemplary case, each of the plurality of bends may comprise a radius of curvature 20 which may be different to each other. In this manner, the direction in which an oil channel 9 extends is customizable such that hard to reach areas may yet be cooled using the above oil injector 6 while a substantially primary flow of oil is maintained.

Figure 5:
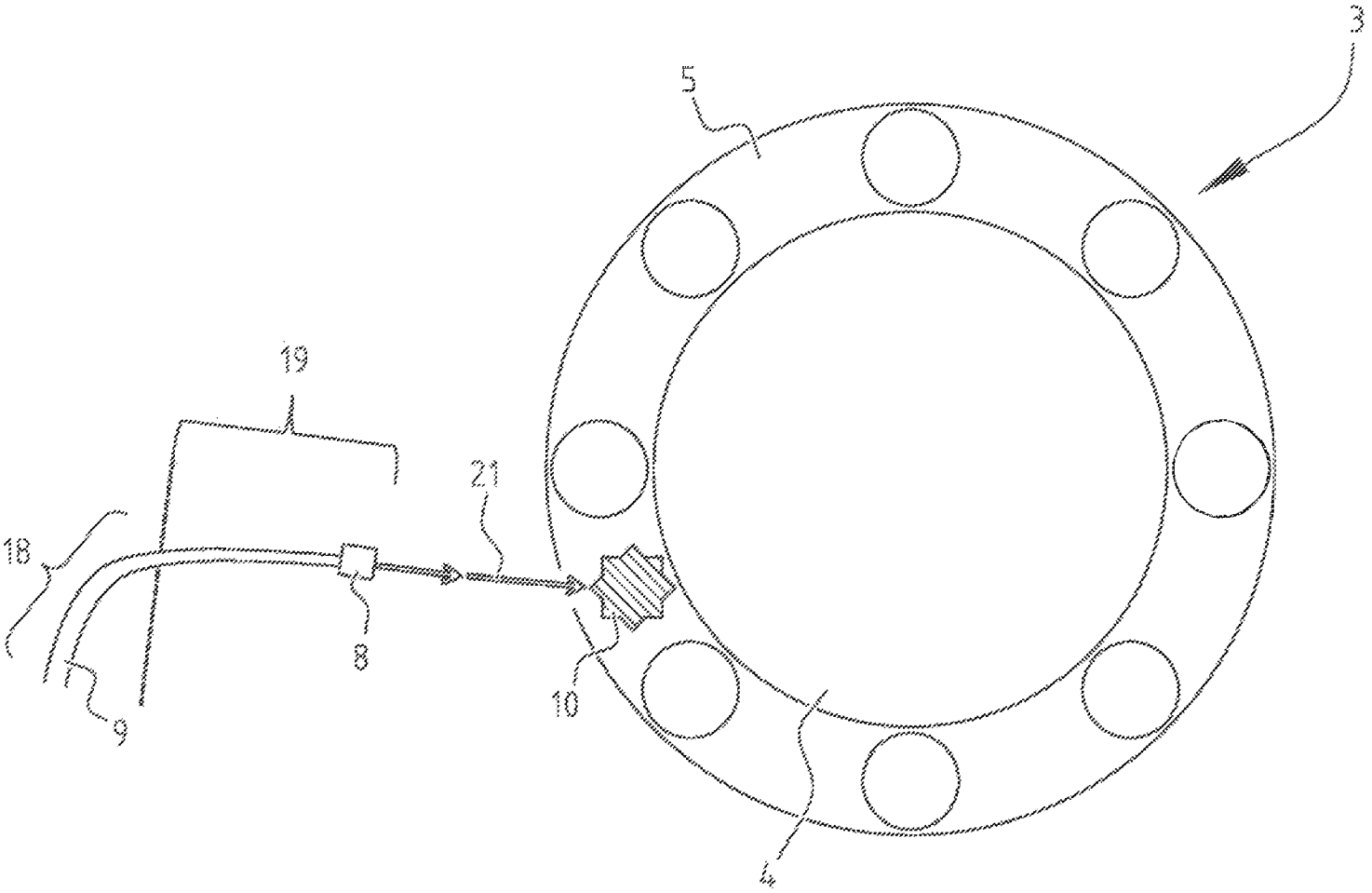
FIG. 5 is a schematic representation of oil ejected from an oil nozzle at an injection location according to an exemplary embodiment.

FIG. 3A further illustrates that each of the oil channels 9*a*, 9*b* and/or nozzles 8*a*, 8*b* may have a different shape depending on an injection location, see FIG. 5 for further details regarding the injection location. It is preferred that the shape of the oil channels 9*a*, 9*b* and/or oil nozzles 8*a*, 8*b* is such that the oil flow is a substantially primary flow of oil. In the context of the application, the primary flow is defined as a flow parallel to the main direction of the fluid motion of the flow of oil, i.e. the centre line CL of the oil channel 9. A primary flow may thus be interpreted as a flow which is substantially unidirectional. In other words, the flow of oil is aligned with the direction of the oil channel 9.

The primary flow is preferably a flow with a Dean number smaller than 75, preferably smaller than 65, preferably smaller than 60. the Dean number is determined by the formula $$De = Re \cdot \sqrt{\frac{D_n}{2 \cdot r}}$$

wherein Re represent a Reynolds number of the flow of oil; wherein $D_n$ represents an inner diameter of the oil channel 9; and wherein r represents a radius of curvature 20 of the oil channel 9 or a portion thereof.

Alternatively, the Dean number is determined by the formula:

$$De = \frac{2\sqrt{2}}{\pi} \cdot \frac{\dot{m}}{\mu} \cdot \sqrt{\frac{1}{D_n \cdot r}}$$

Wherein μ represents a dynamic viscosity of the oil; $D_n$ represents an inner diameter of the oil channel 9; and $\dot{m}$ represents the mass flow rate.

Further alternatively, the Dean number is determined by the formula:

$$De = \frac{D_n^{5/6}}{\mu} \cdot \sqrt{\frac{2^S}{r}} \cdot \sqrt{\frac{\rho^2 \cdot P}{\pi \cdot K}}$$

wherein ρ represents a density of the oil; μ represents a dynamic viscosity of the oil; r represents a radius of curvature 20 of the oil channel 9 or a portion thereof; P represents the pumping power of a pump supplying the flow of oil; $D_n$ represents an inner diameter of the oil channel 9; and K represents a correction coefficient. The skilled person will appreciate that different oil channels 9 may have different shapes, mass flow rates and sizes while maintaining a primary flow based on the above formula or a combination thereof:

$$De - Re \cdot \sqrt{\frac{D_n}{2 \cdot r}} - \frac{2\sqrt{2}}{\pi} \cdot \frac{\dot{m}}{\mu} \cdot \sqrt{\frac{1}{D_n \cdot r}} - \frac{D_n^{5/6}}{\mu} \cdot \sqrt{\frac{2^S}{r}} \cdot \sqrt{\frac{\rho^2 \cdot P}{\pi \cdot K}}$$

Experiments have shown that the same mass flow rate may be maintained whilst lowering for example the pumping power. In this way, the efficiency of the compressor element 1 is further improved in addition to improved cooling of intermediate elements 5 due to the primary flow of oil.

FIG. 3B illustrates a perspective view of yet another different exemplary embodiment of an oil injector 6. In the embodiment of FIG. 3B the oil injector 6 is shown to comprise three oil channels 9*a*, 9*b*, 9*c*. Each of the three oil channels 9*a*, 9*b*, 9*c* comprises a proximal end arranged on a single inlet port 7 and extends from the respective proximal end to a distal end. At the distal end a nozzle 8*a-h* may be arranged. Each of the oil channels 9*a*, 9*b*, 9*c* may comprise a plurality of nozzles 8*a*-8*h*, respectively. In an exemplary case nozzle 8*a* is arranged at a distal end of the oil channel 9*a*. Optionally, a nozzle, for example nozzle 8*b*, may be arranged on an intermediate section of the oil channel 9*a*. Optionally, a plurality of nozzles 8*c-d* and 8*f-h* may be arranged at respectively a distal end of the oil channels 9*b*, 9*c*. Optionally, a plurality of nozzles 8*c-d* may be arranged at a distal end of the oil channel 9*b* and a nozzle 8*e* may be arranged in an intermediate section of the oil channel 9*b*. The skilled person will appreciate that a plurality of nozzles (not shown) may also be arranged in the intermediate section. In this way, both a first side and a second side of an intermediate element (not shown) may be cooled. This is further described in FIGS. 5 and 6. A combination of both embodiments is shown in oil channel 9*b* wherein the distal end thereof is formed by two nozzles 8*c*, 8*d* and the side of the oil channel 9*b* comprises a nozzle 8*e*. Moreover, it will also be clear that more than three nozzles may be arranged on an oil channel 9*a*, 9*b*, 9*c*, for example five oil nozzles may be arranged on an oil channel 9*a*, 9*b*, 9*c*.

Figure 4:
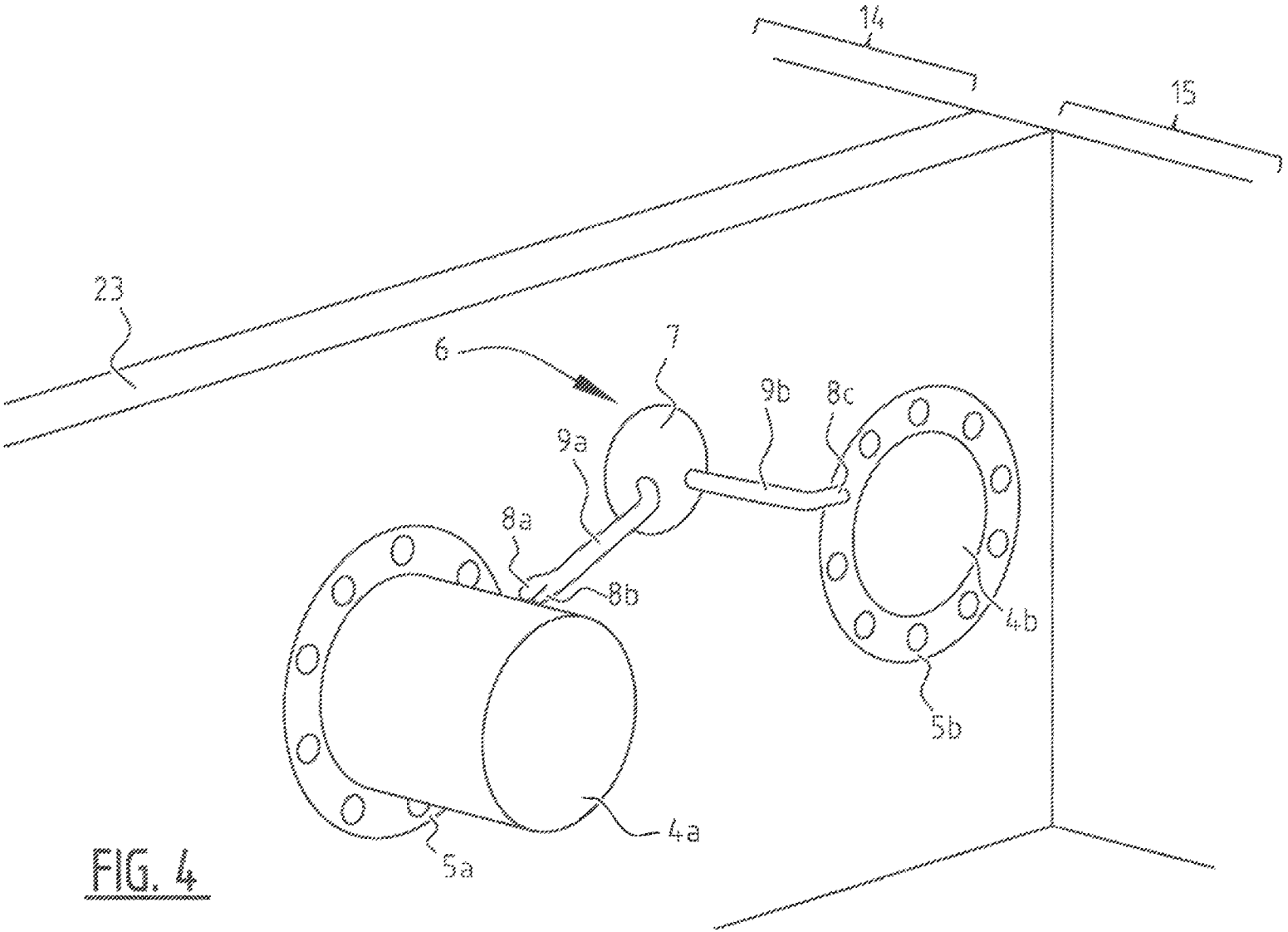
FIG. 4 is a schematic perspective view of an exemplary embodiment of an oil injector arranged in a portion of the compressor element.

FIG. 4 illustrates a perspective view of a side of the housing 3 of the compressor element 1. In the embodiment of FIG. 4, two rotatable shafts 4*a*, 4*b* extend through the side of for example the compression chamber 14 into a further driving section, e.g. a bearing case. An intermediate element 5*a*, 5*b* is provided between the housing 3 and each of the rotatable shafts 4*a*, 4*b*. The intermediate elements 5*a*, 5*b* are illustrated as plain bearings comprising rolling elements such as balls or cylinder rollers. The embodiment of FIG. 4 illustrates in particular that a single inlet port 7 may be used to cool a plurality of intermediate elements 5*a*, 5*b*. In the exemplary embodiment a first oil channel 9*a* extends from the inlet port 7 to nozzles 8*a*, 8*b*. The nozzles 8*a-b* are biased in a direction of the rotatable shaft 4*a*. The second oil channel 9*b* extends from the inlet port 7 to the nozzle 8*c* which, in the exemplary case, is biased to the rotatable shaft 4*b*. It is noted that the area wherein the rotatable shaft 4*a*, 4*b* protrudes is typically limited due to built constraints and weight optimization of a compressor element 1, therefore the space for the arrangement of an oil injector 6 is limited. As is illustrated in FIG. 4, the oil injector 6 is arranged on the side of the housing 3 at a distance from the at least one intermediate element 5*a*, 5*b*. The oil nozzles 8*a-c* are configured to eject oil in a direction of an intermediate element 5*a*, 5*b*. The ejected oil forms, at least initially when ejected from the nozzle 8*a-c*, a substantially primary stream. In other words, in the exemplary embodiment of FIG. 4, three oil streams are ejected in a direction of two intermediate elements 5*a-b*.

FIG. 5 illustrates a schematic cross section of a rotatable shaft 4 wherein an intermediate element 5 is provided between the rotatable shaft 4 and the housing 3. FIG. 5 in particular illustrates that an oil channel 9 comprises at least one nozzle 8 which is configured to eject oil over a span. An oil stream 21 ejected from the nozzle 8 is adapted to impact an injection location 10 (shown in FIG. 4). The span is defined as the distance between the nozzle 8 and the intermediate element 5. The oil stream 21 ejected from the nozzle 8 is represented by the arrows. The oil stream 21 is adapted to impact an injection location 10 on the intermediate element 5. An area of the injection location 10 is preferably smaller than 10 $mm^2$, more preferably smaller than 5 $mm^2$. In other words, it is preferred that a compact stream of oil is maintained without the formation of droplets. Moreover, it is preferred that the compact stream of oil is maintained over substantially the entire span. The injection location 10 may for example be the section of a bearing between two raceways of said bearing. In this way the oil stream 21 may be used for simultaneously cooling and lubricating of the intermediate element 5. It will be clear to the skilled person that once the oil stream 21 impacts the injection location 10, the oil stream 21 may be dispersed. It is preferred that the at least one nozzle 8 is arranged in a substantially close vicinity of the injection location 10. The substantially close vicinity may be defined as an area wherein the span is smaller than 20 mm, preferably smaller than 15 mm, more preferably smaller than 10 mm. In this way it is guaranteed that ejected oil stream 21 impacts the intended injection location 10. This improves the efficiency of cooling the intermediate element 5. Because the oil channel 9 extends from the inlet port 7 to the nozzle 8, the length of the oil channel 9 may be substantial. Moreover, it may be required to incorporate a plurality of bends in order to avoid contact with, for example, intermediate elements 5. This increases the cost and complexity of the oil nozzle 8. In an embodiment where such complexity is unwanted or impossible the oil channel 9 and nozzle 8 may be adapted to eject an oil stream 21 over a long span of at least 20 mm, preferably at least 30 mm, more preferably at least 40 mm. In this way the oil nozzle 8 is more compact and less complex. This reduces the fabrication cost of the oil nozzle 8.

FIG. 5 further illustrates that an oil channel 9 may comprise a transport section 18 and a nozzle section 19. The transport section 18 is defined as the section between the proximal end and the nozzle section 19 of the oil channel 9. The transport section 18 may extend in any direction. It will be clear that the oil channel 9 may be curved over the entire length of the transport section 18.

The nozzle section 19 is defined as a distal end of an oil channel 9 comprising the oil nozzle 8. The nozzle section 19 has a length of at least 2 mm, more preferably at least 5 mm, most preferably 10 mm. It is preferred that the nozzle section 19 is substantially straight such that oil ejected from the nozzle 8 forms a substantially primary stream.

Figure 6:
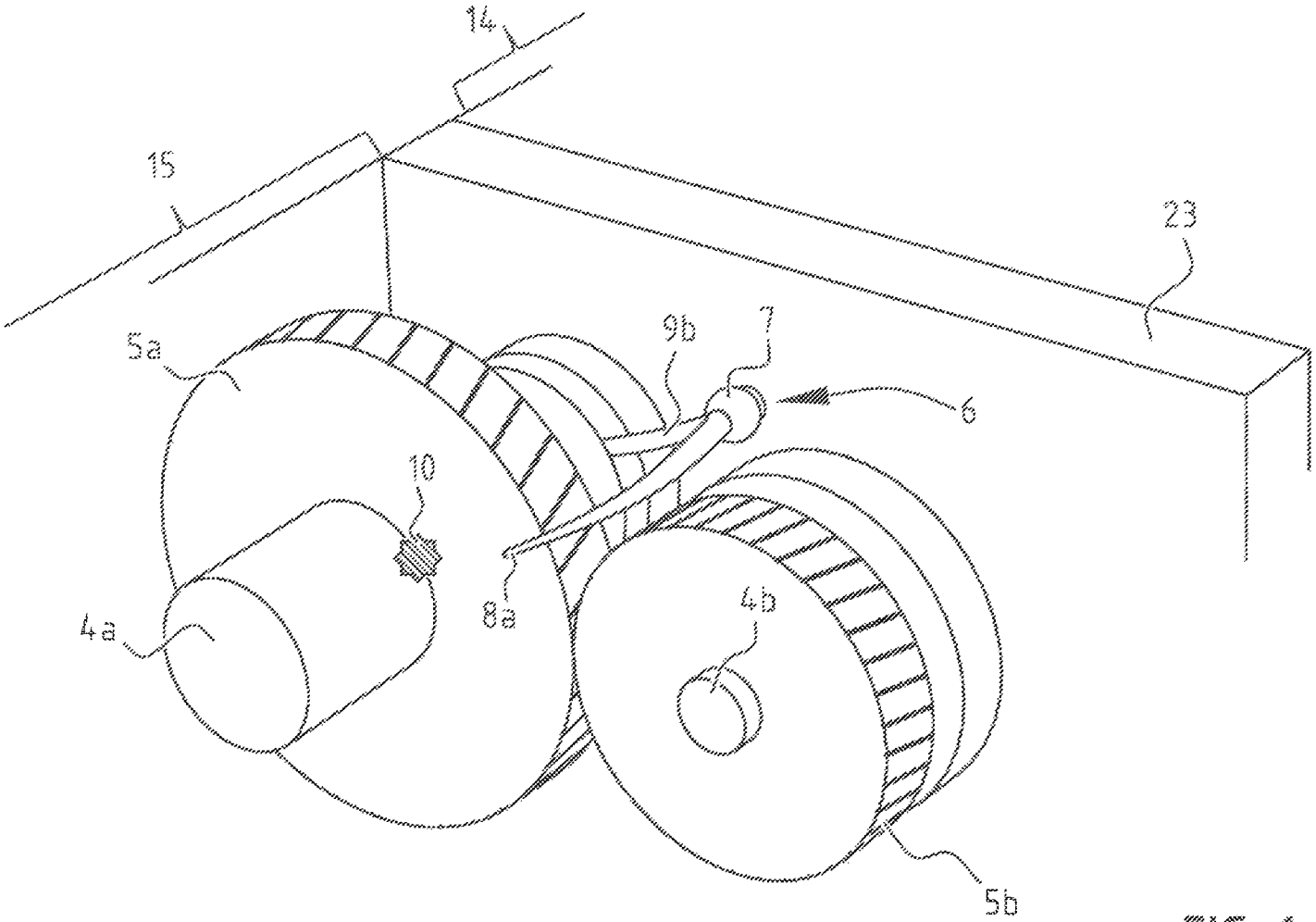
FIG. 6 is a schematic perspective view of another exemplary embodiment of an oil injector arranged in a portion of the compressor element.
Figure 7:
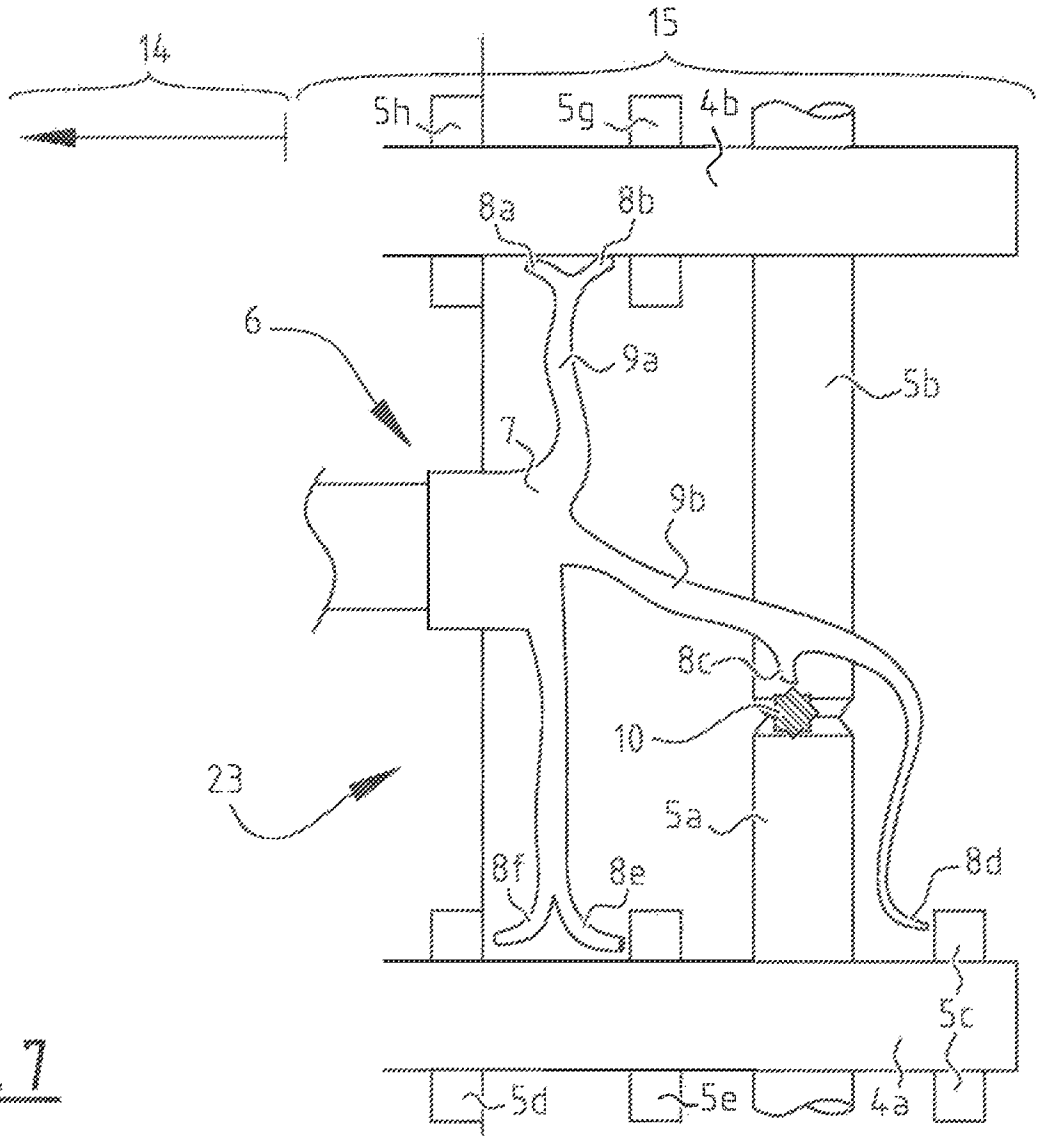
FIG. 7 is a schematic cross-sectional view of an exemplary embodiment of an oil injector.

FIGS. 6 and 7 illustrate further embodiments of the compressor element 1 each comprising an oil injector 6. In FIG. 6 a gearbox of a compression member 2 is illustrated comprising two rotatable shafts 4*a*, 4*b* and two intermediate elements 5*a*, 5*b* illustrated as driving and a driven gear. The intermediate elements 5*a*, 5*b* are mounted to the rotatable shafts 4*a*, 4*b* respectively at a centre distance of each other and cooperate at a gear meshing location. The oil injector 6 is shown to be arranged on the side of the housing 3 and comprises an oil channel 9*a* which extends in a direction away from the housing 3 and over the driving gear 5*a*. The oil nozzle 8*a* is biased in the direction of the rotatable shaft 4*a* such that an oil stream ejected from the nozzle impacts an injection location 10 situated on the rotatable shaft 4*a*. The oil injector 6 further comprises a second oil channel 9*b* which extends in an area between the housing 3 and the intermediate element 5*a*. In this way a single oil injector 6 may be used to cool a first side of the driving gear and a second side opposite to the first side.

FIG. 7 illustrates a further embodiment of a compression member 2 comprising a gearbox wherein a single inlet port 7 is used to cool a plurality of intermediate elements 5*a-f*. FIG. 7 illustrates in particular the limited available space. FIG. 7 illustrates three oil channels 9*a*, 9*b*, 9*c*. Each of the plurality of oil channels 9*a*, 9*b*, 9*c* respectively comprises a plurality of oil nozzles 8*a-f*. A first oil channel 9*a* comprises two oil nozzles 8*a*, 8*b* at its distal end which are biased to intermediate elements 5*h* and 5*g*. Optionally, a third nozzle (not shown) may be arranged on the first oil channel 9*a* and may be biased to the intersection of the intermediate element 5*b* and the rotatable shaft 4*b*. In this way cooling may be provided to the intermediate element 5*b*. FIG. 7 further illustrates a second oil channel 9*b* which extend over the cooperating intermediate elements 5*b* and 5*a*. A first oil nozzle 8*d* may be arranged at a distal end of the oil channel 9*b* and may be biased to the intermediate element 5*c* for cooling and lubricating thereof. A second oil nozzle 8*c* may be arranged at a side of the second oil channel 9*b* and may be biased to a meshing section of the two intermediate elements 5*b*, 5*a*. Optionally and/or additionally, a third oil nozzle (not shown) may be arranged at the distal end of the oil channel 9*b* and may be biased to an intermediate element 5*f* (not shown). A third oil channel 9*c* is similar to the first oil channel and differs in that it extends in opposite direction of the first oil channel 9*a* such that a second rotatable shaft 4*a* and the intermediate elements 5*d* and 5*e* which facilitate the rotation thereof may be cooled and lubricated.

Based on the figures and the description, the skilled person will be able to understand the operation and advantages of the invention as well as different embodiments thereof. It is however noted that the description and figures are merely intended for understanding the invention, and not for limiting the invention to certain embodiments or examples used therein. Therefore it is emphasized that the scope of the invention will only be defined in the claims.

The invention claimed is:

1. A compressor element (1) comprising at least one compression member (2), a housing (3) and a rotatable shaft (4) rotatably connecting the at least one compression member (2) to the housing (3), wherein at least one intermediate element (5) comprising at least one of a roller bearing and a gear is provided between the rotatable shaft (4) and the housing (3) for facilitating rotation of the rotatable shaft (4), wherein the compressor element (1) further comprises at least one oil injector (6) extending from an inlet port (7) to at least one nozzle (8*a*, 8*b*, 8*c*) via an oil channel (9), wherein the oil channel (9) is shaped with a radius of curvature (20) larger than 5 mm to allow a flow of oil through the channel (9) for cooling of the at least one intermediate element (5) which is aligned with a direction determined by a centre line of the oil channel (9).

2. The compressor element according to claim 1, wherein the flow has a Dean number smaller than 75, wherein the Dean number is determined by the formula $$De = Re \cdot \sqrt{\frac{D_n}{2 \cdot r}}$$

wherein Re represent a Reynolds number of the flow of oil; wherein $D_n$ represents an inner diameter of the channel (9); and wherein r represents a radius of curvature (20) of the channel (9) or a portion thereof.

3. The compressor element according to claim 1, wherein an oil channel (9) comprises at least two nozzles (8*a*, 8*b*).

4. The compressor element according to claim 1, wherein the oil channel (9) is branched (9*a*, 9*b*, 9*c*).

5. The compressor element according to claim 1, wherein the radius of curvature (20) of the oil channel (9) is larger than 10 mm.

6. The compressor element according to claim 1, wherein the at least one oil injector (6) is arranged on the housing (3) at a distance from the at least one intermediate element (5) and wherein the at least one oil nozzle (8*a*, 8*b*, 8*c*) is biased towards the at least one intermediate element (5) and is configured to eject oil from the at least one oil nozzle (8*a*, 8*b*, 8*c*), wherein the ejected oil is adapted to impact an injection location (10), wherein an area of the injection location (10) is smaller than 10 $mm^2$.

7. The compressor element according to claim 1, wherein an oil seal (11) is arranged between the compression member (2) and the at least one intermediate element (5).

8. The compressor element according to claim 1, wherein the housing (3) comprises a compression chamber (14) and a driving section (15) separated by a separation wall (23); wherein the compression chamber (14) comprises the at least one compression member (2) and the driving section (15) comprises the at least one intermediate element (5) and wherein the rotatable shaft (4) extends through the separation wall (23).

9. The compressor element according to claim 6, wherein the oil seal (11) is arranged in the separation wall (23).

10. A method for manufacturing a compressor element (1) comprising at least one compression member (2), a housing (3) and a rotatable shaft (4) rotatably connecting the at least one compression member (2) to the housing (3), the method comprises providing at least one intermediate element (5) comprising at least one of a roller bearing and a gear between the rotatable shaft (4) and the housing (3) for facilitating rotation of the rotatable shaft (4), the method further comprises providing the compressor element (1) with at least one oil injector (6) extending from an inlet port (7) to at least one nozzle (8*a*, 8*b*, 8*c*) via an oil channel (9), wherein the method further comprises:

shaping the oil channel (9) with a radius of curvature (20) larger than 5 mm to allow a flow of oil through the channel (9) for cooling of the at least one intermediate element (5) which is aligned with a direction determined by a centre line of the oil channel (9).

11. The method according to claim 10, wherein the oil channel (9) is shaped to allow the flow with a Dean number smaller than 75, wherein the Dean number is determined by the formula $$De = Re \cdot \sqrt{\frac{D_n}{2 \cdot r}}$$

wherein Re represent a Reynolds number of the flow of oil; wherein $D_n$ represents an inner diameter of the channel (9); and wherein r represents a radius of curvature (20) of the channel (9) or a portion thereof.

* * * * *